United States Patent [19]

Byrd

[11] Patent Number: 4,970,094

[45] **Date of Patent: * Nov. 13, 1990**

[54] PREPARATION AND USE OF ELECTRODES

[75] Inventor: Carl E. Byrd, Richwood, Tex.

[73] Assignee: The Dow Chemical Company, Midland, Mich.

[ * ] Notice: The portion of the term of this patent subsequent to Jul. 26, 2005 has been disclaimed.

[21] Appl. No.: 391,676

[22] Filed: Aug. 8, 1989

Related U.S. Application Data

[63] Continuation of Ser. No. 174,749, Mar. 29, 1988, abandoned, which is a continuation-in-part of Ser. No. 134,269, Dec. 17, 1987, Pat. No. 4,871,703, which is a continuation-in-part of Ser. No. 68,773, Jun. 19, 1987, Pat. No. 4,760,041, which is a continuation-in-part of Ser. No. 848,516, Apr. 7, 1986, abandoned, which is a continuation of Ser. No. 499,626, May 31, 1983, abandoned.

[51] Int. Cl.[5] ..... B05D 5/12

[52] U.S. Cl. ..... 427/126.5; 427/126.3; 427/126.6; 427/380; 427/435; 204/290 R; 204/291

[56] References Cited

U.S. PATENT DOCUMENTS

| | | | |
|---|---|---|---|
| 4,213,843 | 7/1980 | Sato et al. | 427/126 S |
| 4,465,580 | 8/1984 | Kasuya | 204/290 F |
| 4,760,041 | 7/1988 | Beaver et al. | 204/290 R |

FOREIGN PATENT DOCUMENTS

| | | | |
|---|---|---|---|
| 0090435 | 10/1983 | European Pat. Off. | 204/273 |

*Primary Examiner*—John F. Niebling
*Assistant Examiner*—Kathryn Gorgos

[57] ABSTRACT

The invention is a method of making an electrode which comprises applying to an electroconductive nickel-containing substrate a coating solution of metal oxide precursor compound(s) and an etchant capable of etching the surface of the substrate and/or any previously applied coating, heating to remove volatiles from the so-coated substrate to cause the metal values of the precursor compounds and those etched from the substrate or previous coating to be concentrated and recoated on the substrate or previously applied coating, and further heating, in the presence of oxygen, air or an oxidizing agent, to a temperature sufficient to oxidize the metal values.

12 Claims, No Drawings

PREPARATION AND USE OF ELECTRODES

CROSS-REFERENCE TO RELATED APPLICATION

This is a continuation of application Ser. No. 174,749, filed Mar. 29, 1988, now abandoned.

This is a continuation-in-part application of Ser. No. 134,269 filed Dec. 17, 1987, now U.S. Pat. No. 4,871,703 which is a continuation-in-part of Ser. No. 068,773 filed June 26, 1987, now U.S. Pat. No. 4,760,041, which is a continuation of application Ser. No. 848,516 filed Apr. 7, 1986 (now abandoned) which is a continuation of application Ser. No. 499,626 filed May 31, 1983 (now abandoned).

BACKGROUND OF THE INVENTION

This invention pertains to a method for preparing electrodes and to their use in electrolytic cells, for example, brine electrolysis cells.

There are three general types of electrolytic cells used for the production of chlor-alkali: (1) the mercury cell, (2) the diaphragm cell, and (3) the membrane cell. The operation of each of these cells is discussed in Volume 1 of the Third Edition of the KIRKOTHMER ENCYCLOPEDIA OF CHEMICAL TECHNOLOGY, page 799 et. seq. Other electrolytic cells which employ electrodes for electrolysis of aqueous solutions are the so-called "chlorate cells" which do not use a divider or separator between the cathodes and anodes. In the mercury cell, the alkali metal values produced by electrolyzing an alkali metal salt form an amalgam with the mercury; the amalgam, when reacted with water, produces NaOH and frees the mercury which can be recovered and cycled back for further use as a liquid cathode.

In many chlor-alkali electrolytic processes a brine solution (electrolyte) is electrolyzed by passing electric current therethrough in a cell having a diaphragm separator means or a membrane separator means positioned between the cathode means and the anode means. Chlorine is produced at the anode means while sodium hydroxide (NaOH) and hydrogen (H) are formed at the cathode means. Brine is fed continuously to the cells, while Cl, NaOH and H are continuously withdrawn from the cells.

The minimum voltage required to electrolyze an electrolyte into Cl, NaOH and H may be calculated using the thermodynamic data. However, in commercial practice, the theoretical amount of voltage is not achievable and higher voltages must be used to overcome the various resistances inherent in the various types of cells. To increase the efficiency of the operation of a diaphragm or a membrane cell one may attempt to reduce the overvoltages of the electrodes, to reduce the electrical resistance of the diaphragm or membrane, or reduce the electrical resistance of the brine being electrolyzed. The invention herein described results in an electrode particularly useful as a cathode in the electrolysis of brine: cathode overvoltage is substantially reduced, resulting in increased power efficiencies.

Because of the multimillion-ton quantity of alkali metal halides and water electrolyzed each year, even a reduction of as little as 0.05 volts in working voltage translates to very meaningful energy savings. Consequently, the industry has sought means to reduce the voltage requirement.

Throughout the development of chlor-alkali technology, various methods have been developed to reduce the cell voltage. Some practitioners have concentrated on reducing cell voltage by modifying the physical design of the electrolytic cell, while others have concentrated their efforts on reducing the overvoltage at the anode or the cathode. The present disclosure pertains, in part, to a novel process to make an electrode that is characterized by a significantly low overvoltage and to the use of these electrodes in electrolytic cells.

It has been disclosed that an electrode's overvoltage is a function of the current density and its composition (reference: PHYSICAL CHEMISTRY, 3rd ed., W. J. Moore, Prentice Hall (1962), pp. 406–408), where the current density refers to the amperage applied per unit of true surface area of an electrode and composition refers to the chemical and physical makeup of the electrode. Therefore, a process that will increase an electrode's surface area should decrease its overvoltage at a given apparent current density. It is also desirable to use a composition of matter that is a good electrocatalyst: this further reduces the overvoltage.

It is well known in the art to use plasma or flame spraying to coat an electrode with an electroconductive metal. In U.S. Pat. No. 1,263,959 it was taught that anodes may be coated by spraying fine nickel particles onto an anode, wherein the particles are rendered molten and impacted on the iron substrate by means of a blast.

Cathodes, also, have been coated with electroconductive metals. In U.S. Pat. No. 3,992,278, cathodes were coated by plasma spraying or flame spraying an admixture of particulate cobalt and particulate zirconia. When these electrodes are used for the electrolysis of water or an aqueous alkali metal halide salt solution, they are said to give prolonged lowering of hydrogen overvoltage.

Various metals and combinations of metals have been used to coat electrodes by plasma or flame spraying: U.S. Pat. No. 3,630,770 teaches the use of lanthanum boride; U.S. Pat. No. 3,649,355 teaches the use of tungsten or tungsten alloy: U.S. Pat. No. 3,788,968 teaches the use of titanium carbide or titanium nitride and at least one metal and/or metal oxide of the platinum group and a second oxide coating which is porous: U.S. Pat. No. 3,945,907 teaches the use of rhenium; and U.S. Pat. No. 3,974,058 teaches the use of cobalt as a coating with an overcoat of ruthenium.

It is, likewise, well known in the art to make porous electrode coatings by selective leaching. Coating an electrode with particulate nickel, then sintering the nickel as taught in U.S. Pat. Nos. 2,928,783 and 2,969,315; electrodepositing an alloy onto a substrate then leaching out one component of the alloy as taught in U.S. Pat. No. 3,272,788; pressing or cementing two or more components together or onto an electrode substrate and then selectively leaching out one or more of the coating components as illustrated by U.S. Pat. Nos. 3,316,159; 3,326,725; 3,427,204; 3,713,891 and 3,802,878.

It is also disclosed in the art to combine the steps of making electrodes by plasma or flame spraying followed by leaching. It is also disclosed to combine the steps of electroplating followed by leaching. Examples of known methods are illustrated in the following patents; U.S. Pat. No. 3,219,730 teaches coating a substrate with a multiple oxide film coating then removing the substrate by leaching, thus forming an electrode; U.S. Pat. No. 3,403,057 teaches flame or plasma spraying a Raney alloy onto a substrate followed by leaching aluminum out of the alloy thus leaving a porous electrode; U.S. Pat. No. 3,492,720 teaches plasma spraying tungsten, titanium or alloys thereof along with aluminum, thorium and zirconium oxides onto a substrate. The substrate was subsequently removed, leaving a porous electrode.

U.S. Pat. No. 3,497,425 teaches preparing porous electrodes by coating the substrate with a relatively insoluble metal followed by a coating of a more easily dissolvable metal. The teaching requires heat treating to cause interdiffusion of the two coats, while optimum conditions require separate heat treatments for each coat. The dissolvable metal is subsequently leached out, leaving a porous electrode. U.S. Pat. No. 3,618,136 teaches forming porous electrodes by coating a binary salt composition onto a substrate and leaching a soluble component from the system. The patent teaches that it is critical that the binary salt mixture is a eutectic composition and that optimum results are obtained when the same anions are used for both the active and the inactive salts, e.g. silver chloride-sodium chloride.

Netherlands Patent Application No. 75-07550 teaches the preparation of porous cathodes by applying to a substrate a coating of at least one nonnoble metal from the group of nickel, cobalt, chromium, manganese and iron, alloyed with a secondary, less noble, sacrificial metal followed by removal of at least a part of this sacrificial metal. Specifically, the sacrificial metal is chosen from the group of zinc, aluminum, magnesium and tin. The sacrificial metal is removed by leaching with a lye solution or an acid solution.

Japanese Patent No. 31-6611 teaches forming a porous electrode by electroplating onto a substrate a nickel coating followed by a coating of zinc or some other soluble substance which is soluble in an alkaline solution. These coated electrodes are then either immersed in an alkaline solution or subjected to an electrochemical anodizing treatment to elute and remove zinc and other soluble substances, thus forming a porous electrode. Prior to immersion, a heat treatment of the coated electrode is required in some embodiments.

U.S. Pat. No. 4,279,709 discloses a method for making electrodes including electrodes having reduced overvoltage by applying an admixture of particulate metal and a particulate inorganic compound pore former and then leaching out the pore former to form pores.

Electrodes of film-forming metal substrates, especially titanium, coated with oxides of Group VIII metals of the Periodic Table of The Elements have been taught, especially conjointly with other metal oxides, as being useful as anodes in electrolytic processes, such as in brine electrolysis. Ruthenium oxides, platinum oxides, and other oxides of the "platinum metal series", in association with various other metal oxides have received much acclaim as coatings for valve metal substrates (esp. Ti) for use as anodes. Patents relating to such anodes are, e.g. U.S Pat. Nos. 3,632,498 and 3,711,385. These coatings may be applied in several ways, for example, U.S. Pat. No. 3,869,312 teaches that platinum group metal oxides, combined with film-forming metal oxides may be deposited on valve metal substrates by applying a mixture of thermally decomposable compounds of platinum group metals and a thermally-decomposable organo-compound of a film forming metal in an organic liquid vehicle which may also optionally contain a reducing agent, to a support member, drying the coating by evaporation of the organic vehicle, then heating the member in the range of 400°-550° C. to form metal oxides. Repeated coats are applied to increase the thickness of the coating Also an overcoating of a film-forming metal oxide is applied. U.S. Pat. No. 3,632,498 teaches that coatings of finely divided oxides of platinum group metals and film-forming metals may be produced by use of a plasma burner, by heating substrates which have been coated with thermally-decomposable compounds of platinum group metals and film-forming metals, by electrically depositing the metals in a galvanic bath followed by heating in air to form the oxide, among others.

Some further patents relating to electrodes having metal oxide surfaces are, e.g., U.S. Pat. Nos. 3,616,445; 4,003,817; 4,072,585; 3,977,958; 4,061,549; 4,073,873; and 4,142,005.

The use of platinum group metal oxides, particularly ruthenium oxide, in active coatings for the evolution of hydrogen is also known (ref. Melendres, Carlos A., SPRING MEETING ELECTROCHEM. SOC., May 11-16, 1975). Japanese patent publication no. 9130/65, application (OPI) nos. 131474/76 and 11178/77 refer to the use of a mixture of platinum group metal oxide(s) with another metal oxide as active cathode coatings. U.S. Pat. No. 4,238,311 teaches that a cathode coating consisting of fine particles of platinum group metals and/or platinum group metal oxides in nickel is useful as a cathode coating.

In general, it is known by those skilled in the art that the use of oxides of platinum group metals as active catalysts for the evolution of hydrogen in modern electrolytic chlor-alkali cells employing permionic membranes is not useful because of extreme conditions of NaOH concentration and temperature now possible, wherein NaOH concentrations of 30% and temperatures exceeding 95° C. are not uncommon. Oxide coatings prepared according to the known art are found to decrepitate with use and fail by loss of adherence to the substrate, accompanied presumably by substantial reduction, in some cases, to base metals.

It is also well known to those practiced in the art that catalytic coatings consisting of metals with intrinsically low hydrogen overvoltage properties are subject in actual practice to loss of catalytic activity due to overplating with metallic contaminants, such as iron for example, which are commonly present in brine and water employed in the process of electrolysis. Consequently, active coatings found useful by those practiced in the art for evolution of hydrogen in modern electrolytic membrane chlor-alkali cells are limited to the type characterized by high surface area, or porous coatings, with compositions resistant to some degree to chemical attack at these conditions, e.g. nickel or various stainless steels.

In these cases, the full effect of the catalytic nature of intrinsically low hydrogen overvoltage catalysts are not realized in practice, since, as is well known to those practiced in the art, the performance of these essentially high surface area coatings degrades in time to a level characterized by the equivalent coating of the predominant metallic contaminant present in the brine or water employed in the electrolytic process, usually Fe. Consequently, the Tafel slope characterizing the electrolytic activity of the applied coating changes to essentially that of iron, with a resulting increase in hydrogen overvoltage, especially at higher current densities, i.e. 1.5 to 3.5 amps per square inch and above, as are common in modern membrane chlor-alkali cells. In contrast, it is desirable to maintain the intrinsically low overvoltage properties of those materials which are known to be characterized by low Tafel slopes, i.e. platinum group metal oxides, particularly ruthenium oxide, during long-term operation in membrane chloralkali cells. It has now been discovered, among other things, that active coatings of oxides of platinum group metals and secondary electrocatalytic metals may be prepared which, when prepared according to the process of the invention, exhibit unexpected properties of low hydrogen overvoltage, physical stability, and long-term efficacy as cathodes in the electrolysis of brine at conditions of high NaOH concentrations, temperatures, and process pressures. It has also been discovered that the use of these electrodes in electrolytic processes wherein chlorine and caustic soda are produced at certain process conditions of temperature, NaOH concentration, pressure, etc., results in reduced energy requirements not otherwise attainable in practice.

SUMMARY OF THE INVENTION

The invention is a method of making an electrode which comprises applying to an electroconductive nickel-containing substrate a coating solution of metal oxide precursor compound(s) and an etchant capable of etching the surface of the substrate and/or any previously applied coating, heating to remove volatiles from the so-coated substrate to cause the metal values of the precursor compounds and those etched from the substrate or previous coating to be concentrated and recoated on the substrate or previously applied coating, and further heating, in the presence of oxygen, air or an oxidizing agent, to a temperature sufficient to oxidize the metal values.

DETAILED DESCRIPTION OF THE INVENTION

Electrodes comprising an electrically conductive, or nonconductive substrate having a coating of heterogeneous oxide mixtures of platinum group metals and secondary electrocatalytic metals are prepared by applying soluble metal compounds and an etchant for the substrate, and, in cases of successive coats, etching the metal oxides previously applied to the substrate, thereby, it is believed, attacking and solubilizing the least chemically resistant portions of the coating, then, as the substrate is heated to oxidize the metal values, concentrating and redepositing the said metal values on the substrate, and oxidizing them to produce a substantially hard, stable mixture of heterogeneous oxides of the metal values.

The preferred electrically-conductive substrate may be any metal structure which retains its physical integrity during the preparation of the electrode. Metal laminates may be used, such as a ferrous metal coated with another metal, e.g., nickel or a film-forming metal (also known as valve metal). The substrate may be a ferrous metal, such as iron, steel, stainless steel or other metal alloys wherein the major component is iron. The substrate may also be a nonferrous metal, such as a film-forming metal or a nonfilm-forming metal, e.g., Ni. Film-forming metals are well known in these relevant arts as including, notably, titanium, tantalum, zirconium, niobium, tungsten and alloys of these with each other and with minor amounts of other metals. Nonconductive substrates may be employed, especially if they are then coated with a conductive layer onto which the instant metal oxides are deposited.

The shape or configuration of the substrate used in the present coating process may be a flat sheet, curved surface, convoluted surface, punched plate, woven wire, expanded metal sheet, rod, tube, porous, nonporous, sintered, filamentary, regular, or irregular. The present novel coating process is not dependent on having a substrate of a particular shape, since the chemical and thermal steps involved are applicable to virtually any shape which could be useful as an electrode article. Many electrolytic cells contain foraminous (mesh) sheets or flat plate sheets; these are sometimes bent to form "pocket" electrodes with substantially parallel sides in a spaced-apart relationship.

The preferred substrate configuration comprises expanded mesh, punched plate, woven wire, sintered metal, plate, or sheet, with expanded mesh being one of the most preferred of the porous substrates.

The preferred composition of the substrate comprises nickel, iron, copper, steel, stainless steel, or ferrous metal laminated with nickel, with nickel being especially preferred. It will be understood that these substrates, onto which the metal oxide coatings are to be deposited, may themselves be supported or reinforced by an underlying substrate or member, especially where nickel, iron, or copper is carried by, or on, an underlying substrate or member. The substrate, onto which the metal oxide coating is to be deposited, may itself be an outer layer of a laminate or coated structure, and it may be, optionally, a nonconductive substrate onto which the metal oxide coating is deposited.

The platinum metal series comprises Ru, Rh, Pd, Os, Ir, and Pt. Of these, the preferred metals are platinum and ruthenium, with ruthenium being most preferred. The soluble platinum metal compound may be the halide, sulphate, nitrate or other soluble salt or soluble compound of the metal and is preferably the halide salt, such as RuCl hydrate, $PtCl_4$ hydrate, and the like.

The coating solution can include a secondary electrocatalytic metal oxide precursor which comes from the substrate. The secondary electrocatalytic metal oxide precursor of the present coating may be at least one derived from a soluble compound of Ni, Co, Fe, Cu, W, V, Mn, Mo, Nb, Ta, Ti, Zr, Cd, Cr, B, Sn, La, or Si. The preferred of these are Ni, Zr, and Ti, with Ni being the most preferred.

The solution of the present invention contains at least one chemically active agent capable of etching the substrate, and, in the case of second and later coatings, etching and solubilizing the most chemically-susceptible portions of the oxides previously formed, while also, preferably as the temperature is elevated, vaporizing, in many cases, from the heated mixture, along with volatilized anions or negative valence radicals from the platinum metal oxide precursor and the secondary electrocatalytic metal oxide precursor. The preferred chemically active etchants comprise most common acids, such as hydrochloric acid, sulphuric acid, nitric acid, phosphoric acid: also hydrazine hydrosulphate, and the like, with hydrochloric acid and hydrazine hydrosulphate being among the most preferred. Alternatively, a peroxide can be used as an etchant. Hydrogen peroxide is especially preferred. Alternatively, a mixture of a peroxide and an acid can be used as an etchant.

In general, the preferred method contemplated in the present invention comprises applying to the desired substrate a solution containing at least one platinum metal series compound, at least one electrocatalytic metal compound, and a chemical etchant, preferably containing a volatile organic vehicle, such as isopropanol, and allowing the volatile vehicle to evaporate, leaving the etchant and the dissolved metal values; then heating the substrate to a temperature sufficient to concentrate the metal values, also substantially driving out the volatilized etchant along with the anions or negative-valence radicals released from the metal oxide precursors, and heating the substrate in the presence of oxygen or air to a temperature sufficient to thermally oxidize and convert the metals to metal oxides in-situ on the substrate. The steps may be repeated a plurality of times in order to attain the best full effect of the invention by increasing the thickness of the coating. Furthermore there is, at times, a benefit to be derived from laying down 2 or more layers of the metal oxide precursors between each thermal oxidation step.

In a particularly preferred embodiment an electrode material is prepared by applying a heterogeneous metal oxide coating, said heterogeneous metal oxide coating comprising nickel oxide (which came from the etchant acting on the Ni substrate) and a platinum group metal oxide (optionally containing a modifier metal oxide, e.g., ZrO), onto a nickel metal layer (which may be in the form of a nickel layer on an electroconductive substrate) by the process which comprises (a) applying to said nickel metal layer a coating solution comprising a platinum group metal oxide precursor, a modifier metal oxide, and an etchant for dissolving the most soluble portions of the nickel metal surface, (b) heating to evaporate volatile portions of the coating solution, thereby concentrating and depositing the metal oxide precursors on the so-etched nickel metal surface, (c) heating in the presence of air or oxygen at a temperature between about 300° C. to about 600° C. for a time sufficient to oxidize the metals of the metal oxide precursors, and (d) cooling the so-prepared electrode material. Additional coatings may be applied in similar manner so as to increase the thickness of the so-produced heterogeneous metal oxide coating on the nickel metal surface, though the etchant for the second and later coating applications may beneficially be the same as, or different from, the etchant used in the initial coating application. There is thus prepared an electrode material comprising a nickel metal layer having tightly adhered thereto a heterogeneous metal oxide coating, said heterogeneous metal oxide coating comprising nickel oxide and a platinum group metal oxide. Preferably, the platinum group metal oxide is ruthenium oxide. The preferred optional modifier metal oxide is zirconium oxide. An economical form of the nickel metal layer is that of a nickel layer on a less expensive electroconductive substrate, such as steel or iron alloys. Such electrode material is particularly useful as cathodes in chlor-alkali cells.

Ordinarily the temperature at which thermal oxidation of the metals is achieved is somewhat dependent on the metals, but a temperature in the range of about 300° to 650° C., more or less, is generally effective. It is generally preferred that the thermal oxidation be performed at a temperature in the range of about 350° to 550° C.

The effect of the invention is to produce a substantially hard, adherent coating of heterogeneous oxides of the solubilized metals.

It is within the purview of the present inventive concept that the solubilization, reconcentration, and in-situ deposition of the solubilized metals, using chemical etching of the previously deposited layers and/or substrate produces an intimate mixture of oxides which are mutually stabilizing and electrocatalytically complementary.

The following examples illustrate particular embodiments, but the invention is not limited to the particular embodiments illustrated.

EXAMPLE 1

A solution is prepared which consists of about 3 grams $RuCl \cdot 3H_2O$, about 5 milliliters of a 37 weight percent aqueous HCl solution, and about 100 milliliters of a 3 weight percent hydrogen peroxide solution. The solution is prepared by mixing together all ingredients and stirring for approximately 6 hours.

A cathode is prepared which is constructed of a 40% expanded mesh of nickel. The cathode is first sandblasted. The cathode is coated by dipping it into the coating solution, allowing it to air dry, then baking it in an oven at a temperature of from about 475° to about 500° C. for about 20 minutes. In the same manner, a total of 6 coats are applied.

The sample is analyzed by scanning electron microscopy and X-ray diffraction (XRD). The secondary electron images are taken on the JEOL T-300 scanning electron microscope. Energy dispersive X-ray spectroscopy elemental analysis is done at different points. The XRD patters are collected on the Scintag diffractometer, Cu radiation. The surface of the coated cathode is heavily covered with polyhedral structures, which contain a higher Ru concentration than the matrix. The XRD pattern show $RuO_2$ and $NiO_2$, as well as Ni.

It is within the purview of the present invention to employ the present novel electrodes at temperatures encountered in cells operated at super-atmospheric pressures, as well as at atmospheric or subatmospheric pressures. The electrodes are especially suitable for operation in the elevated temperature range of about 85° to about 105° C. Pressures at around 1 atm, more or less, are ordinarily used in chlor-alkali cells, though pressures up to about 3 atm. or more may be used.

The electrodes of the present invention are useful in cells wherein circulation within each electrolyte compartment is created by the gas-lift (displacement) action of gaseous products produced therein, though in some cells, such as in electrolyte series flow from cell-to-cell, another pumping means may be provided to supplement, or substitute for, the gas-lift action. We find it advisable, in some cases, to maintain the ratio of the volume of catholyte pumped to that of the anolyte volume pumped, at a ratio greater than unity.

The electrodes of this invention are useful in chlor-alkali electrolytic cells in which the anolyte has, or is adjusted to have, a pH in the range of about 1 to about 5, such as when an acid, e.g. HCl, is added to the anolyte.

What is claimed is:

1. A method of making an electrode consisting essentially of the steps of:

(a) applying to an electroconductive nickel-containing substrate a coating solution of at least one metal oxide precursor compound and an etchant capable of etching the surface of the substrate or any previously applied coating, (b) heating the coated substrate to remove volatiles from the so-coated substrate to cause the metal of the precursor compounds and those etched from the substrate or previous coating to be concentrated and recoated on the substrate or previously applied coating, and (c) further heating the coated substrate, in the presence of oxygen, air or an oxidizing agent, to a temperature sufficient to oxidize the metal.

2. The method of claim 1 wherein the metal oxide precursor compounds are selected from the group of metal chlorides, nitrates, sulphates, or phosphates.

3. The method of claim 1 wherein the metal precursor compounds comprise at least one metal compound from the group of Ru, Rh, Pd, Os, Ir, or Pt, and at least one from the group of Ni, Co, Fe, Cu, W, V, Mn, Mo, Nb, Ta, Ti, Zr, Cd, Cr, B, Sn, La, and Si.

4. The method of claim 1 wherein the metal of at least one of the metal precursor compounds is that of the substrate.

5. The method of claim 1 wherein the etchant is from the group of hydrochloric acid, sulphuric acid, nitric acid, phosphoric acid, a peroxide, and hydrazine hydrosulphate.

6. The method of claim 1 wherein the etchant is hydrogen peroxide.

7. The method of claim 1 wherein the etchant is a mixture of an acid and a peroxide.

8. The method of claim 1 wherein the etchant is a mixture of hydrochloric acid and hydrogen peroxide.

9. The method of claim 1 wherein the coating procedure is repeated at least once.

10. The method of claim 1 wherein the coating procedure is repeated a plurality of times.

11. The method of claim 1 wherein the temperature at which the oxidation of the metal is carried out is in the range of from about 300° to about 600° C.

12. The method of claim 1 wherein the heating of the substrate takes place for a period of time of about 5 to about 60 minutes.

* * * * *